United States Patent [19]

Schmitz

[11] Patent Number: 4,546,781

[45] Date of Patent: Oct. 15, 1985

[54] PERMANENT WAVE CURLER

[76] Inventor: Wolfgang Schmitz, Aachener Strasse 609, 5000 Köln 41, Fed. Rep. of Germany

[21] Appl. No.: 549,559

[22] Filed: Nov. 7, 1983

[30] Foreign Application Priority Data

Dec. 1, 1982 [DE] Fed. Rep. of Germany ..... 3244408

[51] Int. Cl.[4] ..... A45D 2/00

[52] U.S. Cl. ..... 132/31 R; 132/34 R; 132/40

[58] Field of Search ..... 132/34 R, 34 B, 34 C, 132/31 R, 42

[56] References Cited

U.S. PATENT DOCUMENTS

| | | | |
|---|---|---|---|
| 1,931,645 | 10/1933 | Connolly | 132/34 B |
| 2,627,861 | 2/1953 | Peyton | 132/34 R |
| 3,430,636 | 3/1969 | Compere | 132/34 R |
| 3,939,851 | 2/1976 | Parlagreco | 132/34 R |
| 4,022,225 | 5/1977 | Kauffman | 132/34 C |
| 4,037,612 | 7/1977 | Ferrier | 132/31 R |

*Primary Examiner*—Gregory E. McNeill

*Attorney, Agent, or Firm*—Browdy and Neimark

[57] ABSTRACT

A permanent wave curler (41) has a roller sleeve (42) onto which a lock of hair can be rolled up and which, after the lock of hair has been rolled up, must be fixed with respect to the latter. In order to prevent kinks from forming on the rolled-up lock of hair, stopping levers (43) are arranged at both ends of the roller sleeve, which levers lie approximately radially with respect to the sleeve axis and are rotatably mounted on the latter, it being possible to couple the stopping levers with the roller sleeve (42) at least in the direction in which the lock of hair is unwound. The spindles (44, 45) of the stopping levers (43) are rotatable separately from each other and can be coupled with the roller sleeve (46) separately from each other (FIG. 6).

15 Claims, 7 Drawing Figures

PERMANENT WAVE CURLER

Figure 1:
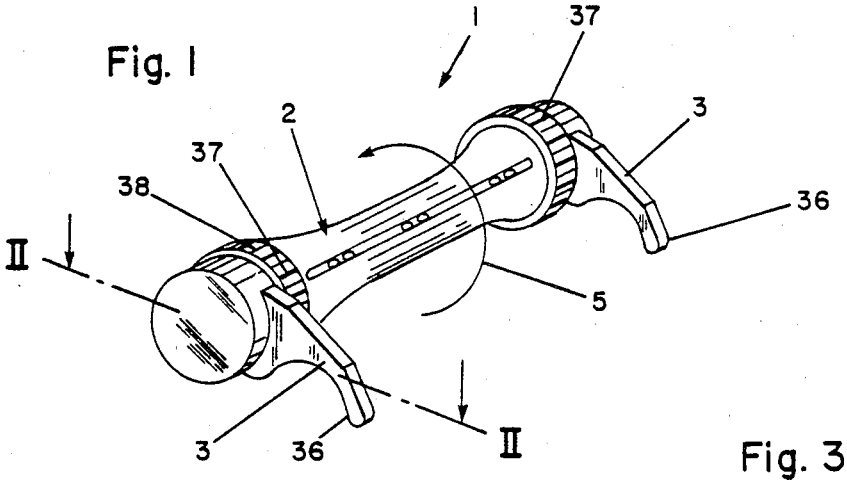

The invention relates to a permanent wave curler with a roller sleeve on which a lock of hair can be rolled up and which, after the lock of hair has been rolled up, can be fixed with respect to the latter.

Various embodiments of permanent wave curlers are known. Known curlers, in addition to the roller sleeve, have at least one other part by means of which the rolled-up lock of hair is secured to the curler. This additional securing element, which can take the form of a clip, rubber ring, push-on collar or similar object, presses against the rolled-up lock of hair in at least one spot and creates there a kink which, during treatment, not only produces an undesired and uncontrolled wave in the lock of hair, but also involves the danger of some of the hairs breaking off.

The problem of kinks is known, and hairdressers try to avoid such kinks by using various tricks such as small wooden sticks, various bases, etc. which are intended to support the hair. However, these methods are relatively costly and can only be used successfully by skilful hairdressers.

The object of the invention is to provide a permanent wave curler which can be secured on the head, with a rolled-up lock of hair, without causing a kink and which, in addition, can be easily handled even by untrained people.

According to the invention, this object is achieved by arranging stopping levers at both ends of the roller sleeve, which levers lie approximately radially with respect to the sleeve axis and are rotatably mounted on the latter, and in that the stopping levers can be coupled with the roller sleeve at least in the direction in which the lock of hair is unwound.

In the case of the curler according to the invention, the lock of hair need merely be rolled up on the roller sleeve, without requiring a separate element for holding the lock on the roller sleeve. The stopping levers which can be coupled with the roller sleeve, rest, when the lock of hair has been rolled up, on the scalp or even on a neighbouring curler, whilst the lock of hair lies freely around the roller sleeve and, together with the sleeve, is held in this position. Since separate holding elements are no longer required, it is also impossible for kinks to occur any more. The rolled-up lock of hair, which extends vertically away from the scalp, rises tangentially onto the curler and is held sufficiently firmly on the latter. After treatment has been carried out, the lock of hair can be easily released from the curler by uncoupling the roller sleeve from the stopping levers so that the curler can be readily removed.

The handling of the permanent wave curler according to the invention is very simple and even untrained people can quickly learn to use it. Since there is no need to handle additional holding elements, the rolling up and subsequent releasing of the curler can also be carried out more quickly than with conventional curlers.

In a preferred design of the curler according to the invention, both the stopping levers can be non-rotatably seated on a common spindle which runs through the roller sleeve and is rotatably mounted in the latter. In this design, both the stopping levers always have the same angular position with respect to the roller sleeve.

Preferably there is provided a disengageable coupling which acts between the spindle and the roller sleeve and which can be manufactured and handled relatively easily in a great variety of forms.

For example a ratchet coupling can be provided as the coupling, which coupling functions in the manner of a freewheel coupling. The lock of hair, therefore, can then be freely wound up on the roller sleeve, while at the same time rotation of the sleeve in the direction in which the hair is unwound, is prevented, so that the roller sleeve, after the lock of hair has been rolled up, can rest on the scalp via the stopping levers, without becoming detached from the lock of hair. When the lock of hair, after treatment, is to be released from the roller sleeve, the ratchet can be separated from the corresponding toothing by a relative displacement between spindle and roller sleeve, so that the roller sleeve can also be freely rotated in the opposite direction with respect to the stopping levers.

The spindle bearing the stopping levers is preferably designed as two parts, the end of one part being mounted in the other part in a non-rotatable but axially displaceable manner. The two spindle parts can be pushed apart by means of a spring, the one spindle part resting against the roller sleeve and the other spindle part keeping the ratchet coupling engaged, one half of which coupling is seated on the appropriate spindle part and the other half on the roller sleeve.

The two spindle parts which are connected to each other so that they are non-rotatable and axially displaceable can be connected to each other in the manner of a spline shaft, the end of one spindle part preferably having a cross-section which deviates from the circular form and is guided in a corresponding recess in the other spindle part.

The stopping levers are preferably seated on end caps, each of which engages over, with play, an end section of the roller sleeve, which end section has a reduced diameter. As a result of this design, handling of the curler is simplified and there is no danger of the individual hairs being caught up in the rotating mechanism.

The end caps which are provided with the stopping levers can be securely seated on the outer ends of the spindle parts and can be pressed together against the pressure of the spring. When the end caps are pressed together, the coupling is disengaged, so that the curler can simply be removed with one hand by pressing the end caps against each other in the axial direction with the aid of the thumb and another finger and at the same time removing the curler. This technique of releasing the curler is not only extremely simple, but is also considerably quicker than in the case of known curlers.

The freewheel coupling can have two coupling surfaces which face each other in the axial direction and which are each provided with an axial sawtooth profile. In one direction the two profiles can slide over each other, whereas in the opposite direction, the unrolling direction, they are always locked, it being possible for the two halves of the coupling to be optionally separated from one another for example by outside pressure on the end caps.

Alternatively, one half of the ratchet coupling can be provided with a radial or axial sawtooth profile, whereas the other half of the coupling is provided with several elastic tongues which are arranged so that they are spread over the circumference and which optionally can be engaged with and disengaged from the sawtooth profile.

Preferably the two stopping levers are designed so as to be curved approximately in the radial plane, the free ends of the levers, after the lock of hair has been rolled up, being able to rest on the scalp or on a neighbouring curler.

For easier handling, the roller sleeve can have on both its lateral edges a radially projecting protuberance which is provided with a rough surface and which facilitates rotation of the roller sleeve with respect to the stopping levers.

According to another embodiment of the invention, the two stopping levers are preferably seated on separate, single spindles which are rotatable with respect to each other and which can be coupled with the roller sleeve independently of each other in one and the same direction of rotation, each via a freewheel coupling. This embodiment has the advantage that the rolling up of a lock of hair is considerably simplified and can be carried out faster since, in the case of this embodiment, it is possible to rotate alternately the two opposite rotatable ends of the permanent wave curler and engage the roller sleeve each time a single rotation of the respective stopping lever is performed, whereas the other stopping lever, due to the freewheel coupling, can be rotated in the opposite direction with respect to the roller sleeve.

The freewheel coupling can comprise elastic arms which are provided on each single spindle, are radially projecting and curved in one and the same direction of rotation and which engage in an internal toothing provided in the roller sleeve, it being possible for the arms to be disengaged from the internal toothing by axial displacement of the single spindles towards each other and hence to be uncoupled from the roller sleeve.

One of the two single spindles, where appropriate, has a cylindrical recess in its inner end, in which recess the facing end of the other single spindle is rotatably mounted. As a result, the design is made relatively simple.

Furthermore, the two stopping levers do not have to be arranged in a precisely radial manner, but can also preferably be inclined inwards towards each other. As a result, the distance between the free ends of the stopping levers is reduced and the positioned curler requires less room and no longer interferes with neighbouring curlers.

Figure 3:
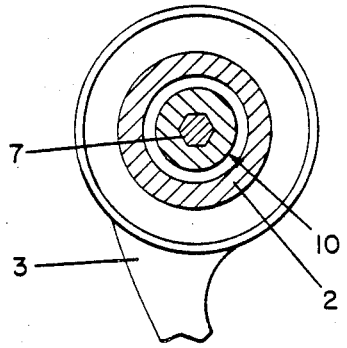
Figure 2:
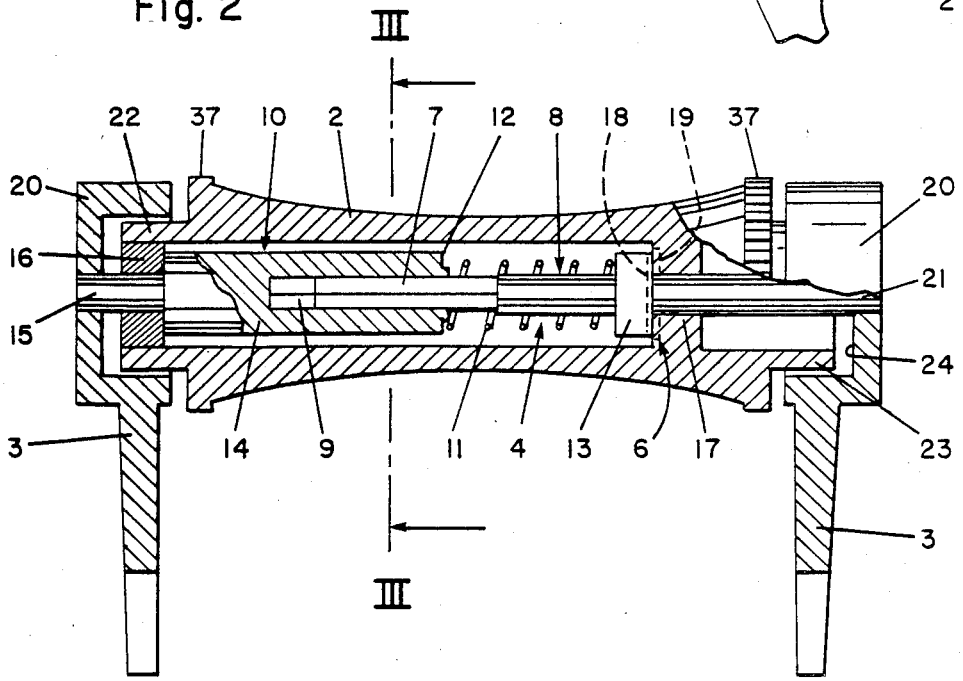
Figure 4:
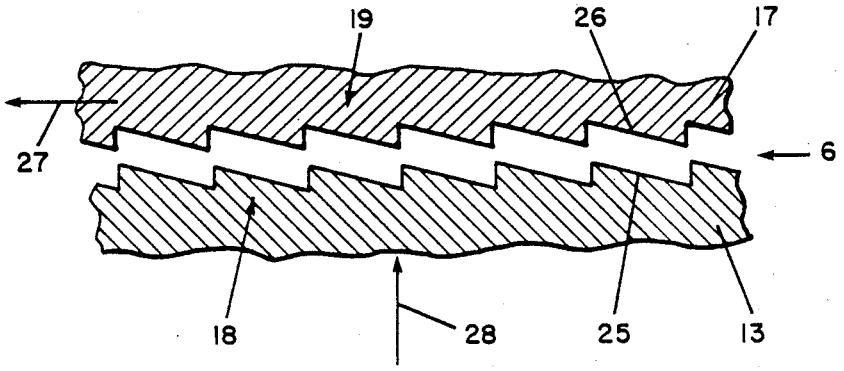
Figure 5:
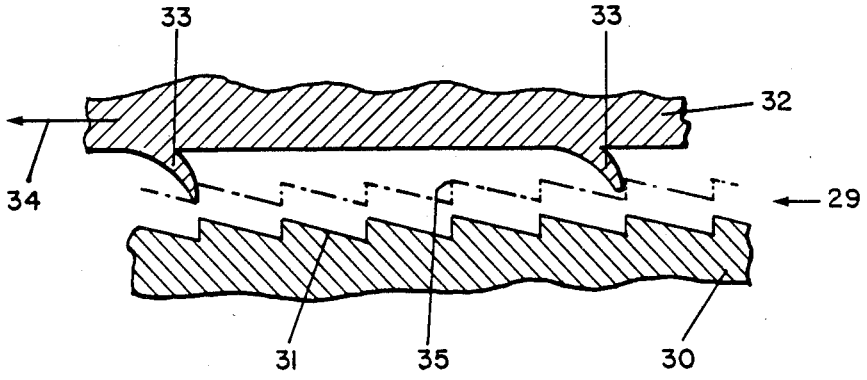
Figures 6, 7:
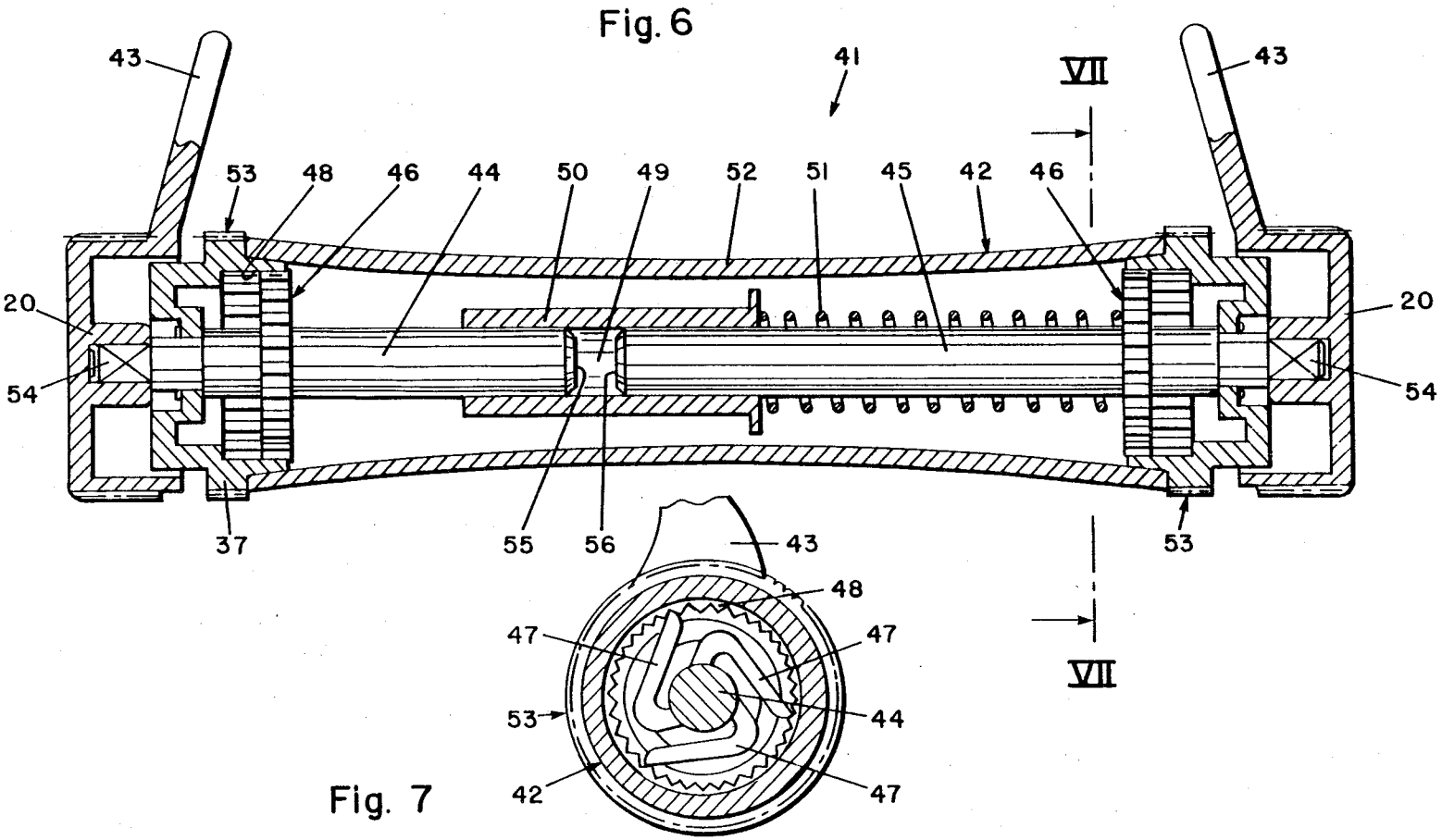

The invention is illustrated by way of example in the drawing and is described in detail below with reference to the drawing in which:

FIG. 1 is a perspective view of an illustrative embodiment of a permanent wave curler, FIG. 2 is an enlarged view of a section along the line II—II of FIG. 1, FIG. 3 is a section along the line III—III of FIG. 2, FIG. 4 is a simplified, developed illustration of an illustrative embodiment of the disengageable freewheel coupling, FIG. 5 is also a diagrammatic illustration of another illustrative embodiment of the freewheel coupling, FIG. 6 is a section, similar to FIG. 2, of another embodiment of the permanent wave curler, and FIG. 7 is a section along the line VII—VII of FIG. 6.

According to the drawing, the permanent wave curler 1 comprises substantially a roller sleeve 2, which like traditional roller sleeves has a tapered cross-section in the middle area, as well as two stopping levers 3 which are arranged at both ends of the roller sleeve 2, lie approximately radially with respect to the sleeve axis and are rotatably mounted on the sleeve 2.

The two stopping levers 3 are seated on a common spindle 4 in such a way that they always have the same angular position with respect to the roller sleeve 2. In the winding-on direction, which is indicated in FIG. 1 by means of the arrow 5, the sleeve 2 can be freely rotated via a freewheel coupling 6, whereas it is blocked in the opposite direction in which a lock of hair is unwound.

The spindle 4 of the two stopping levers 3, which runs through the roller sleeve, is formed by two parts, the end 7 of one part 8 being mounted in a corresponding recess 9 of the other spindle part 10 so that it is non-rotatable but axially displaceable in the manner of a spline shaft. The end 7 of the spindle part 8 has a regularly hexagonal cross-section which fits positively into the correspondingly hexagonally formed recess 9 and hence creates a positive locking in the direction of the circumference, while axial displacement of the two parts with respect to each other is possible.

The two spindle parts 8 and 10 are pushed apart with the aid of a helical spring, the spring 11 resting on one side against the end face 12 of one spindle part 10 and on the other side against a shoulder 13 of the other spindle part 8.

In the case of the spindle part 10, the section 14 provided with the recess 9 has a widened cross-section, whereas the end section 15, which is connected to the corresponding lever 3, has a smaller cross-section. The end section 15 is mounted in a retaining ring 16 which is inserted into the roller sleeve 2. At the same time the widened section 14 of the spindle part 10 rests against this retaining ring in the axial direction.

The other spindle part 8 is rotatably mounted in an internal projection 17 of the sleeve 2 and rests with its shoulder 13 against this projection in the axial direction.

The shoulder 13 provided on the spindle part 8, as well as the internal projection 17 of the sleeve 2, at the same time are supports for the two halves 18 and 19 of the freewheel coupling 6. The two halves 18 and 19 of the coupling are therefore constantly pressed against each other by means of the spring 11 so that the freewheel coupling, in the normal position shown in the drawing, is permanently effective. Therefore, when a lock of hair is rolled up on the roller sleeve 2, the roller sleeve can be freely rotated with respect to the stopping levers 3, while the rotating movement of the sleeve is blocked in the direction in which the hair is unwound.

The two stopping levers 3 are seated on end caps 20 which are securely fitted onto the outer ends 15 and 21 of the two spindle parts 8 and 10 and which each engage over, with play, an end section 22 or 23 of the roller sleeve 2, which end section has a reduced diameter.

The internal surface 24 of at least that end cap 20 which is connected to the spindle part 8 is arranged at a sufficient distance from the end face of the reduced end section 23 so that, by applying external pressure to the end cap 20, the halves 18 and 19 of the freewheel coupling 6 can be separated from one another, in order to enable free rotation of the sleeve 2 in both directions. Uncoupling is necessary in order to remove the curler.

The freewheel coupling 6 can have various embodiments. FIG. 4 shows the freewheel coupling 6 of FIG. 2 on an enlarged scale and in developed form. In this embodiment the axial front sides of the shoulder 13 of the spindle part 8 as well as those of the projection 17 of the sleeve 2, which front sides face each other, are each provided with an axial sawtooth profile 25 or 26 so that the sleeve 2 can rotate, with respect to the spindle shoulder 13 connected to the levers 3, in the direction of the arrow 27 shown in FIG. 4, while in the oppposite direction of rotation it is blocked. For the sake of clarity, the two halves of the coupling are shown in FIG. 4 in their separated, that is ineffective state. In order to engage the coupling, the half 18 of the coupling is moved in the direction of the arrow 28 until it comes into contact with the half 19 of the coupling.

In the illustrative embodiment of another freewheel coupling 29, shown in FIG. 5, the half 30 of the coupling is provided with an axial or radial sawtooth profile 31, whereas the other half 32 of the coupling has several elastic tongues 33 which are arranged so that they are spread over the circumference. In FIG. 5 the freewheel coupling is shown in the uncoupled state, in which the sleeve 2 is freely rotatable in both directions with respect to the stopping levers 3. For coupling, the half 30 of the coupling must be brought into the position indicated by a dot-dash line, where the elastic tongues 33 rest against the sawtooth profile 31. In the coupled state, therefore, the freewheel coupling 6 permits movement of the part 32 of the coupling in the direction of the arrow 34, whereas movement in the opposite direction is blocked by the tongues 33 which run up against the steep sides 35 of the sawteeth.

As can be seen in particular from FIG. 1, the stopping levers 3 are designed so as to be curved away from the direction in which the lock of hair is wound on, which direction is indicated by the arrow 5, the free ends 36, which are slightly rounded, resting on the scalp after the lock of hair has been rolled up and, in conjunction with the freewheel coupling 6 or 29, preventing the lock of hair from unwinding.

During use of the permanent wave curler according to the invention, the end of a lock of hair is placed around the roller sleeve 2 in the direction of the arrow 5 and the roller sleeve is then rotated, with respect to the stopping levers 3, in the direction of the arrow 5, the lock of hair gradually being rolled up on the roller sleeve 2. In order to facilitate rotation of the roller sleeve 2, radially projecting protuberances 37 are provided on both the lateral edges of the roller sleeve 2, which protuberances are provided with a rough surface and facilitate rotation of the roller sleeve 2. The roughness of the surface can, for example, comprise grooves 38 running in the axial direction.

When the lock of hair is completely rolled up on the roller sleeve 2, the free ends 36 of the stopping levers rest on the scalp, and the freewheel coupling 6 or 29 prevents the roller sleeve 2 from being rotated backwards, with the result that the curler with the rolled-up lock of hair remains securely in position without the need for any additional holding elements.

After treatment, a lateral pressure merely has to be applied to the end caps 20, as a result of which the halves of the freewheel coupling 6 or 29 separate, so that the roller sleeve 2 becomes freely rotatable with respect to the stopping levers and the permanent wave curler simply needs to be removed.

In addition to the illustrative embodiments shown in the drawing, further designs are possible. For example, the spindle, on which the two stopping levers 3 are seated, can be designed as a continuous rigid spindle, the freewheel coupling 6 being uncoupled, for example, by axial displacement of the roller sleeve 2 on this spindle.

Furthermore, it is also possible to use two separate freewheel couplings and guide the ends 22 of the roller sleeve, which have a reduced diameter, through the end caps 20 so that the protuberances 37 provided for rotation of the roller sleeve 2 can then be arranged on the outside of the end caps.

The permanent wave curlers can be manufactured relatively easily, since the parts can be designed as simple, injection-molded, plastic parts which can be produced in large amounts at low cost and can be easily assembled. The individual parts to be connected together can be secured by means of snap-on connections, adhesion or similar techniques. A plastic which is resistant to the particular perm liquid applied is chosen as the material.

The embodiment of the permanent wave curler 41, shown in FIGS. 6 and 7, resembles very closely, in principle, the embodiment described above. However, there are a few essential differences, as will be described below. Those features which are the same or similar in both embodiments will be mentioned briefly or not at all.

The permanent wave curler 41 again comprises the same main component parts, namely a roller sleeve 42 as well as two stopping levers 43 which are rotatably mounted at both ends of the roller sleeve 42.

Unlike the illustrative embodiment shown in FIG. 1, the stopping levers 43 are seated on separate single spindles 44 and 45 which are rotatable with respect to each other. As a result, the levers 43 which are provided on opposite sides of the curler can therefore be swiveled independently of each other, but only in one direction. The other direction of rotation is blocked by freewheel couplings 46, a separate freewheel coupling being assigned to each single spindle 44 and 45.

As can be seen in particular from FIG. 7, the freewheel couplings 46 comprise three radially projecting arms 47 which are molded onto each single spindle, have a resilient springing design and are curved in one and the same direction of rotation. All three arms 47 engage into an internal toothing 48 which is provided on the inside surface of the roller sleeve and over which the said arms are able to slide in one direction, whereas in the other direction they run up against the teeth and cause a coupling effect. It is of decisive importance in the present case that the single spindles 44 and 45 can be rotated independently of each other and can be coupled with the roller sleeve independently of each other.. To this extent, therefore, the stopping levers 43 are rotatable independently of each other in the freewheeling direction and can be coupled with the roller sleeve in the opposite direction.

The freewheel couplings are completely uncoupled in a manner similar to that of the first-described illustrative embodiment, namely by axial displacement of the single spindles 44 and 45 towards each other. In this respect, the arms 47 are pushed out laterally from the internal toothing 48 with the result that the stopping levers 43 can be freely rotated in both directions. Uncoupling is achieved by pressing, with two fingers, on the two end caps 20, thereby pushing the spindles 44 and 45 towards each other and releasing the arms 47 in both the freewheel couplings 46 from the internal toothings 48.

The single spindle 44 has a cylindrical recess 49 on its end which extends inside the roller sleeve. This recess is formed by a collar 50 which is either bonded onto or welded together with the single spindle 44, or which, together with the single spindle, comprises one piece. The facing end of the other single spindle 45 engages into the recess 49 and is mounted in the recess 49 in a rotatable and axially displaceable manner. To ensure that the roller sleeve 42 can be easily rotated even when the end caps 20 are pressed together firmly, a travel stop is provided for the two single spindles 44 and 45. The right-hand single spindle 45 has as a travel stop a stopping face 56 which is located on its front end and comes to rest against a counter stopping face 55 at the bottom of the recess 49.

A helical compression spring 51 is provided between the free front end of the collar 50 and the arms 47 located on the single spindle 45, which spring presses the two single spindles 45 into their outer position where the arms 47 engage into the internal toothings 48.

A further difference between this embodiment and the first-described embodiment is that the roller sleeve 42 comprises three parts, namely the long middle part, on which a lock of hair can be rolled up, and two end parts 53, in which the single spindles 44 and 45 are mounted. The relatively stable end parts 53 also carry the internal toothings 48 of the freewheel couplings 46 as well as the outer annular protuberances 37 with the appropriate grooving.

The single spindles 44 and 45 are provided, at each of their outer ends, with a square section 54 onto which the end caps 20, which have a corresponding recess, are press-fitted.

The arms 43 provided on the end caps 20, unlike the first-described illustrative embodiment, are inclined towards each other so that the free ends of the arms 43 lie closer together and hence do not obstruct neighbouring curlers.

I claim:

1. Permanent wave curler with a roller sleeve onto which a lock of hair can be rolled up and which, after the lock of hair has been rolled up, can be fixed with respect to the latter said curler comprising:

stopping levers affixed, at both ends of the roller sleeve, to a spindle extending through, and being rotably mounted in, said sleeve, each of said levers extending approximately radially with respect to the sleeve axis and being normally non-rotatably coupled to said sleeve at least in the direction in which the lock of hair is unwound, said spindle and said sleeve carrying means for uncoupling said stopping levers from said roller sleeve, said uncoupling means being actuated by moving at least one of said levers in a direction toward, and normal to the longitudinal axis of, said sleeve.

2. Permanent wave curler as claimed in claim 1, wherein each of said levers are coupled to said sleeve via a freewheel coupling (6; 29), the coupling halves of which (18, 19; 30, 32) can be separated from each other by a relative axial displacement between said spindle (4) and said roller sleeve (2).

3. Permanent wave curler as claimed in claim 1, wherein the stopping levers (3) are seated on end caps (20) each of which engages over, with play, an end section (22 or 23) of the roller sleeve (2), which end section has a reduced diameter.

4. Permanent wave curler as claimed in claim 1, wherein the two stopping levers (3) are designed so as to be curved approximately in the radial plane, the free ends (36) of the levers, after the lock of hair has been rolled up, resting on the scalp or on a neighbouring curler.

5. Permanent wave curler as claimed in claim 1, wherein the roller sleeve (2) has on both its lateral edges a radially projecting protuberance (37) which is provided with a rough surface.

6. Permanent wave curler as claimed in claim 1, wherein the two stopping levers (43) are seated on separate single spindles (44, 45) which are rotatable with respect to each other and wherein the single spindles can be coupled with the roller sleeve (42) independently of each other in one and the same direction of rotation, each via a freewheel coupling (46).

7. Permanent wave curler as claimed in claim 2, wherein the spindle (4) comprises two parts (8, 10), the end (7) of one part (8) being mounted in the other part (10) in a non-rotatable but axially displaceable manner, wherein both spindle parts (8, 10) can be pushed apart by means of a spring (11) and wherein the one spindle part (10) rests against the roller sleeve (2) and the other spindle part (8) keeps the freewheel coupling (6) engaged, one half (18) of which coupling is seated on the appropriate spindle part (8) and the other half (19) on the roller sleeve (2).

8. Permanent wave curler as claimed in claim 2, wherein the freewheel coupling (6) has two coupling halves (18, 19) which face each other in the axial direction and which are each provided with an axial sawtooth profile (25, 26), and wherein the two halves (18, 19) of the coupling can optionally be separated from one another.

9. Permanent wave curler as claimed in claim 2, wherein the freewheel coupling can comprise elastic arms (47) which are provided on the spindle (4) or on each single spindle (44, 45), are radially projecting and curved in one and the same direction of rotation and which engage in an internal toothing (48) provided in the roller sleeve (42) and wherein the arms (47) can be disengaged from the internal toothing (48) by axial displacement of the spindle parts (8, 10) or single spindles (44, 45) towards each other.

10. Permanent wave curler as claimed in claim 3, wherein the end caps (20) which are provided with the stopping levers (3) are securely seated on the outer ends (15 or 21) of the spindle parts (8 or 10) and can be pressed together against the pressure of the spring (11).

11. Permanent wave curler as claimed in claim 6, wherein the two stopping levers (43) are inclined inwards towards each other.

12. Permanent wave curler as claimed in claim 7, wherein the end (7) of one spindle part (8) has a cross-section which deviates from the circular form and is guided in a corresponding recess (9) of the other spindle part (10) in a non-rotatable and axially displaceable manner.

13. Permanent wave curler as claimed in claim 8, wherein one half (30) of the freewheel coupling (29) is provided with a radial or axial sawtooth profile (31), whereas the other half (32) of the coupling is provided with several elastic tongues which are arranged so that they are spread over the circumference and which optionally can be engaged with and disengaged from the sawtooth profile.

14. Permanent wave curler as claimed in claim 10, wherein one of the two single spindles (44) has a cylindrical recess (49) at its inner end, in which recess the facing end of the other single spindle (45) is mounted in a rotatable and axially displaceable manner.

15. Permanent wave curler as claimed in claim 14, wherein one (45) of the two single spindles with a stopping surface (56) comes to rest against a corresponding counter stopping surface (55) when the end caps (20) are pressed together.

* * * * *